US008585024B2

(12) United States Patent
Ferree et al.

(10) Patent No.: US 8,585,024 B2
(45) Date of Patent: Nov. 19, 2013

(54) COOLING TOWER

(75) Inventors: David Alan Ferree, Chickasha, OK (US); Billy Wayne Childers, Jr., Chickasha, OK (US)

(73) Assignee: Aggreko, LLC, New Iberia, LA (US)

( * ) Notice: Subject to any disclaimer, the term of this patent is extended or adjusted under 35 U.S.C. 154(b) by 327 days.

(21) Appl. No.: 12/861,068

(22) Filed: Aug. 23, 2010

(65) Prior Publication Data

US 2011/0049733 A1 Mar. 3, 2011

Related U.S. Application Data

(60) Provisional application No. 61/236,901, filed on Aug. 26, 2009.

(51) Int. Cl.
*B01F 3/04* (2006.01)

(52) U.S. Cl.
USPC ..... 261/109; 261/110; 261/DIG. 11

(58) Field of Classification Search
USPC ..... 216/109, 110, 111, DIG. 11, DIG. 85
See application file for complete search history.

(56) References Cited

U.S. PATENT DOCUMENTS

| | | | | |
|---|---|---|---|---|
| 2,606,750 | A * | 8/1952 | Jacir | 261/30 |
| 3,384,165 | A * | 5/1968 | Mathews | 165/122 |
| 4,267,130 | A | 5/1981 | Curtis | |
| 5,227,095 | A | 7/1993 | Curtis | |
| 5,487,531 | A | 1/1996 | Curtis | |
| 5,545,356 | A | 8/1996 | Curtis | |
| 5,958,306 | A * | 9/1999 | Curtis | 261/30 |

FOREIGN PATENT DOCUMENTS

FR 2 597 361 * 10/1987

* cited by examiner

*Primary Examiner* — Charles Bushey
(74) *Attorney, Agent, or Firm* — Law Office of Jesse D. Lambert, LLC

(57) ABSTRACT

A water cooling tower having an improved water collection system. The cooling tower has an outer shell, legs, and one or more layers of fill material, through which the water to be cooled moves vertically downward. The water is distributed across the upper surface of the fill material by piping and nozzles. A fan underlying the fill material moves air vertically upward through the fill material. The water collection system, which is positioned below the fill material, has upper and lower troughs which receive water flowing vertically downward through the fill material. Preferably, the lower troughs are positioned beneath the spaces between upper troughs, to catch water falling between the upper troughs. A number of hinged baffles close off the spaces between lower troughs, but rotate upward in response to upward air flow and open the spaces between the lower troughs.

12 Claims, 6 Drawing Sheets

COOLING TOWER

CROSS REFERENCE TO RELATED APPLICATIONS

This regular patent application claims priority to U.S. provisional patent application Ser. No. 61/236,901, filed Aug. 26, 2009, for all purposes.

BACKGROUND

1. Field of the Invention

This invention relates to cooling towers, used for the cooling of water in various systems. More particularly, this invention relates to a cooling tower, which may be a transportable cooling tower, having an improved water collection system.

2. Description of Related Art

Generally, cooling towers in the relevant field have a tower shell which holds various other components (described below); legs which position the cooling tower shell at a desired elevation above a datum surface (typically the ground or a pad), and which preferably permit transportation of the cooling tower by truck (for example, legs which retract, fold, are removable, or any combination thereof); a means for moving air through the cooling tower, typically one or more fans located at the air inlet or discharge which draw or force air upwardly through the cooling tower through one or more layers of cooling tower fill, positioned above an air inlet area such that air flows upward and counter to downwardly flowing water; a means for distributing water across the upper surface of the fill material, namely a water distribution system above the fill, generally comprising piping including a water supply header, lateral lines, and multiple nozzles to distribute water across the top of the fill surface; and drift eliminators above the water distribution system which minimize the amount of water droplets which are blown out of the unit by the upward air flow.

A key structural and functional element of the cooling tower of the present invention is a water collection system which allows air to pass upwardly through the water collection system while collecting water that falls into it, so that the water can be gravity drained or pumped out for cycling through the system. A further key aspect of the present invention is a cooling tower having a water collection system which gives rise to a number of fabrication and operational advantages over the known existing designs.

DETAILED DESCRIPTION OF SOME OF THE PRESENTLY PREFERRED EMBODIMENTS

Cooling Tower Shell, Legs, Water Distribution System, and Means for Moving Air

Figure 1:
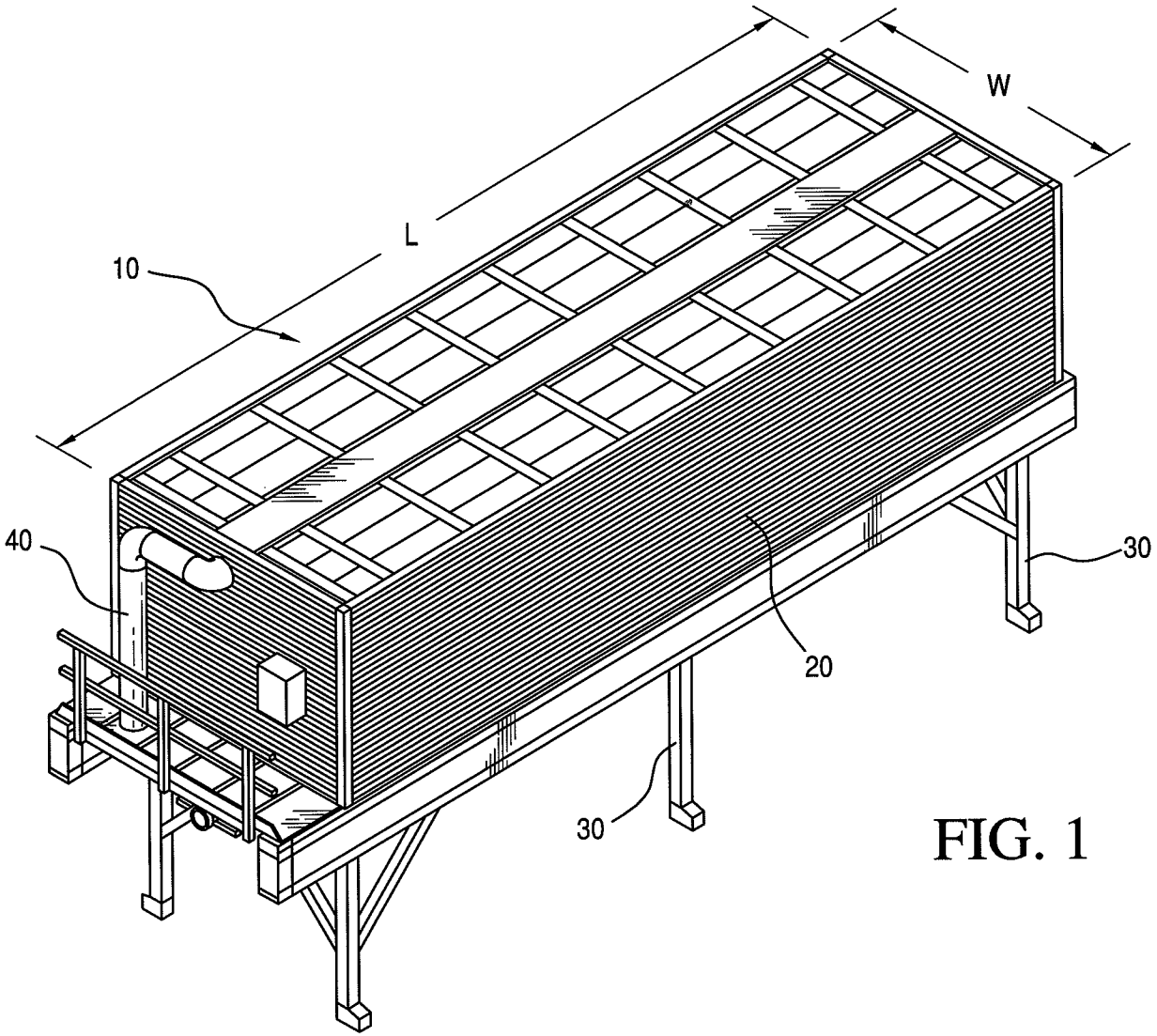
FIG. 1 is an isometric view of an exemplary cooling tower.
Figure 2:
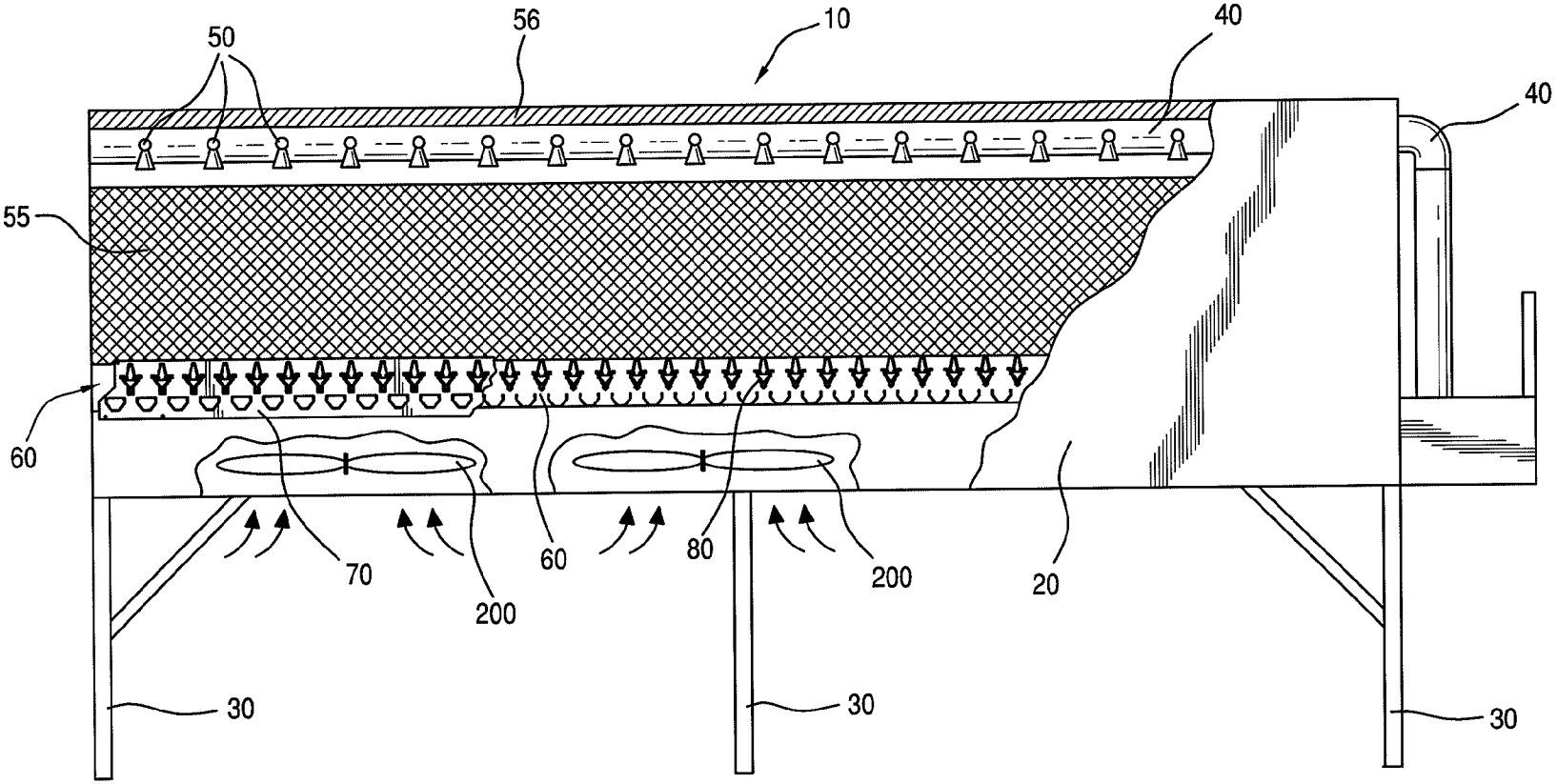
FIG. 2 is a side view in partial cross section of a cooling tower of the present invention, showing further structural detail of the various cooling tower components and detail of the water collection system.

By way of background: FIG. 1 shows an isometric view of a water cooling tower 10 of the present invention. For convenience in describing the invention, water cooling tower 10 has a length L and a width W, both indicated on FIG. 1. FIG. 2 is a side view of water cooling tower 10 in further detail. With reference to those two drawings, an outer shell 20 encloses various elements of the cooling tower as previously described. Legs 30 elevate the structure to a desired height above a base. In the preferred embodiment, legs 30 are of a configuration that permits folding, telescoping or otherwise moving the legs so as to make the cooling tower more compact, for ease in transportation. One or more layers of cooling tower fill material, referred to as fill 55, as positioned within outer shell 20. Fill 55 may be of various forms well known in the relevant art, and provides a large surface area for heat exchange with the water flowing through it.

A means for distributing water across an upper surface of fill 55 is provided. In the preferred embodiment, the means for distributing water comprises piping 40 which delivers water to nozzles 50 positioned over one or more layers of cooling tower fill 55. Nozzles 50 may be of different configurations well known in the art, and spray water downwardly over the top surface of the fill 55, preferably over most of the horizontal surface area of fill 55. A drift eliminator 56 (which may comprise a screen-type structure, or other structure known in the art) is disposed above nozzles 50, which (as earlier described) serves to catch water spray which is driven upward by air flow, past nozzles 50.

While the present invention may have applicability to a number of different types of cooling towers, the present invention has particular applicability to counterflow cooling towers (where the water and the air are moving in opposite directions—namely, the water moving vertically downward, the air moving vertically upward). As is well known in the art, cooling towers (other than "natural draft" cooling towers, which do not employ a fan to move air) have a means for moving air through the cooling tower fill. Air is drawn (in "induced draft" cooling towers, with the fan positioned above the fill) or blown (in "forced draft" cooling towers, with the fan positioned below or perpendicular to the fill). In the present embodiment air is blown upwardly through the cooling water collection system, designated generally as element 60, and through the fill 55, by the means for moving air vertically upward through the cooling tower and fill 55 therein, which in the preferred embodiment comprises one or more fans 200, as shown in FIG. 2. It is understood that the means for moving air through the cooling tower comprises fans positioned below, above, or to the side of the cooling tower, or any combination thereof.

As is known in the prior art and as previously described, the water sprayed over fill 55 moves via gravity downward through fill 55 to water collection system 60, where it is then drained into a basin to be drained or pumped out for cycling through a system.

Figure 5:
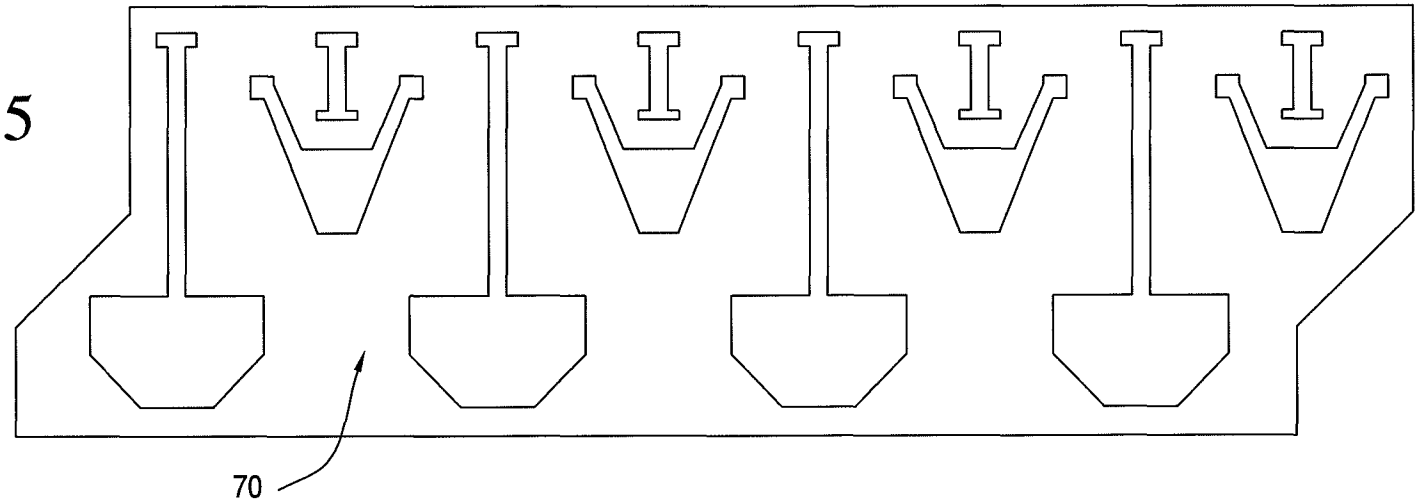
FIG. 5 is a view of an end bracket.
Figure 6:
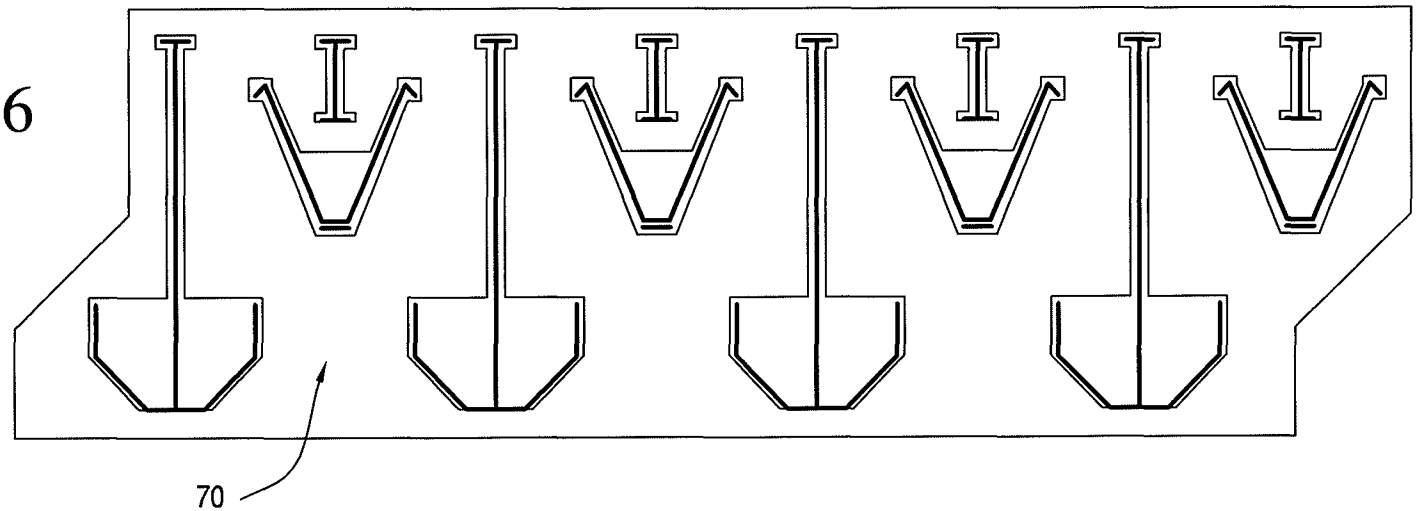
FIG. 6 is a view of an end bracket in place on the cooling tower, holding various elements of the water collection system in place.

Referring to FIG. 2, which is a side view of a cooling tower in partial cross section, various elements of the cooling tower including a portion of the water collection system can be seen in further detail. The various components of the water collection system (shown in more detail in FIGS. 3 and 4 and described in detail below) are held in place via end brackets 70 as shown in FIGS. 5 and 6. As annotated in FIG. 6 for clarity, end brackets 70 are in place over only a portion of the collectors, allowing water to drain from the ends of the troughs (which are described in more detail below).

The Water Collection System

Figure 3:
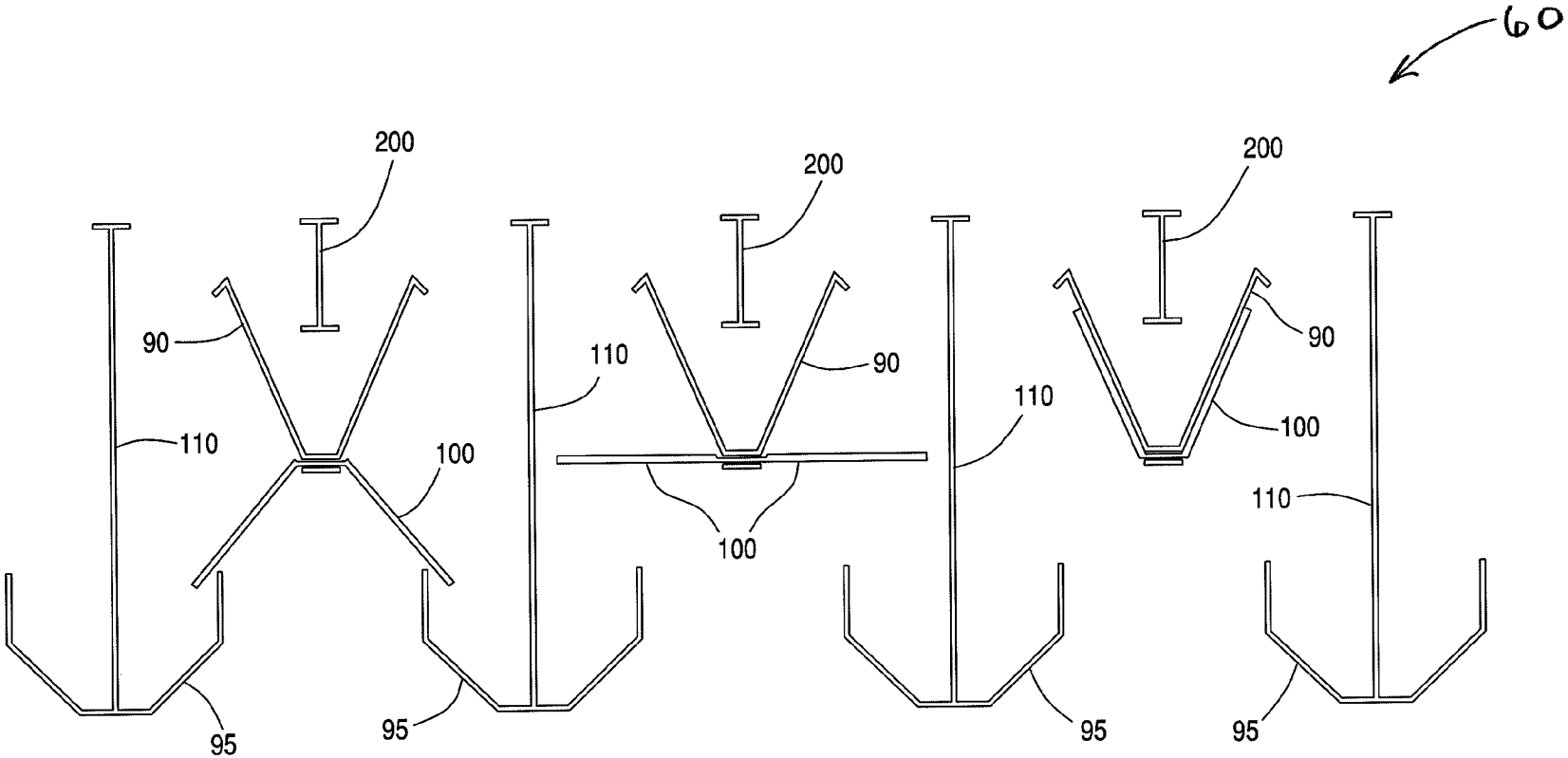
FIG. 3 is a detailed view of various components of the water collection system of the present invention, shown in cross section view from one side of the cooling tower.
Figure 4:
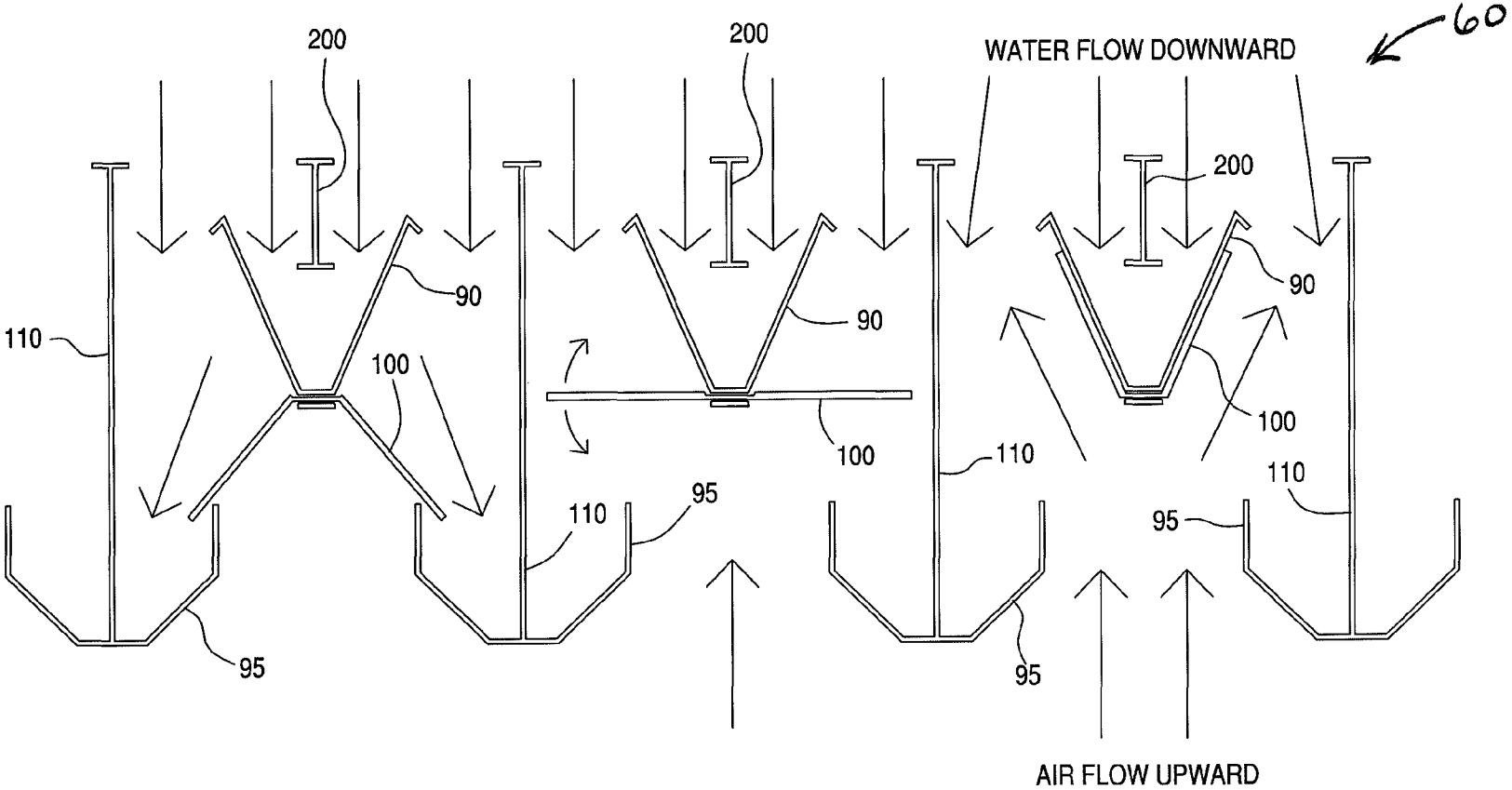
FIG. 4 is another detailed view of the water collection system of the present invention, including arrows showing the directions of water and air flow through the system.

FIGS. 3 and 4 show one embodiment of various components of the water collection system in greater detail. It is understood that FIGS. 3 and 4 show a cross section from the same direction as FIG. 2. Generally, water collection system 60, disposed below fill 55, comprises a plurality of elongated, spaced apart upper troughs 90 and a plurality of elongated, spaced apart lower troughs 95, underlying upper troughs 90. Upper and lower troughs 90 and 95 are positioned so as to run substantially across the width of cooling tower 10. The particular cross section shape (whether a V-shaped cross section, or one with more squared-off or rounded edges) and dimensions of the troughs may be varied to suit water capacity and manufacturing considerations; it is understood that the trough opening faces upward, as shown in the figures. In the preferred embodiment, the troughs are positioned so that a lower trough underlies the space between each upper trough, as shown in the figures. The preferred embodiment may also comprise one or more upper supports 200, which generally span the width of cooling tower shell 20. Upper supports 200 serve to provide support for the fill 55 (and generally structural support for cooling tower 10), and may also serve as a guide for water flowing vertically downward. Depending upon structural requirements, an upper support 200 may be positioned above each of upper troughs 90, as shown.

In the embodiment shown in FIGS. 3 and 4, upper supports 200 have a cross section shape generally resembling an I-beam. It is understood, however, that upper supports may have a variety of cross section shapes, for example a generally inverted V-shape, rectangular, square, etc.

For clarity, FIGS. 3 and 4 are cross section views of the troughs, baffles, etc., without end bracket 70 in place; FIG. 5 is a view of end bracket 70 alone, to better show its shape; and FIG. 6 is an end view with end bracket 70 in place, holding troughs, etc. in position.

Water not collected by upper troughs 90 is collected by bottom troughs 95. Typical water flow paths (along with typical air flow paths) are shown in FIG. 4, where water cascades into the upper and lower troughs 90 and 95. As previously noted, it is understood that upper and lower troughs 90 and 95 run across the width of the cooling tower, substantially spanning the width of cooling tower 10, and are held in place by end brackets 70. Depending upon the dimensions of cooling tower 10, additional brackets similar in shape to end brackets 70 may be positioned as needed between the end brackets. Troughs 90 and 95 drain into basins (not shown) that typically run the length of both sides of cooling tower 10, where the water is diverted into a drain. From there the water can be drained or pumped out as desired for cycling through the system.

In a presently preferred embodiment, water collection system 60 further comprises a plurality of elongated, hinged baffles 100 which are attached below upper troughs 90, as seen in FIGS. 3 and 4. As shown, baffles 100 are hinged so that if no air is moving upward through a particular part of water collection system 60, baffles 100 remain in a first position, rotated downwardly by their weight and closing the space between adjacent bottom troughs. This baffle position can be seen on the leftmost trough/baffle combination in FIGS. 3 and 4. As air begins moving upward past a set of baffles, baffles 100 are moved by the force of the air through the intermediate position shown in the middle trough/baffle combination in FIGS. 3 and 4, to an upper position as can be seen in the rightmost trough/baffle combinations in FIGS. 3 and 4, where baffle 100 may rotate so as to contact the bottom of troughs 90. The baffle system helps to minimize the amount of water which may fall through the spaces adjacent bottom troughs 95, rather than into a bottom trough 95, in any portion of the water collection system 60 through which air is not moving.

The preferred embodiment of water collection system 60 may additionally comprise one or more generally vertically disposed dividers 110, disposed above lower troughs 95, as shown in FIGS. 3 and 4. In the embodiment shown, dividers 110 are positioned above each of the lower troughs 95, but it is understood that dividers 110 may or may not be in any or all lower troughs.

Another Possible Embodiment of the Invention

Figure 7:
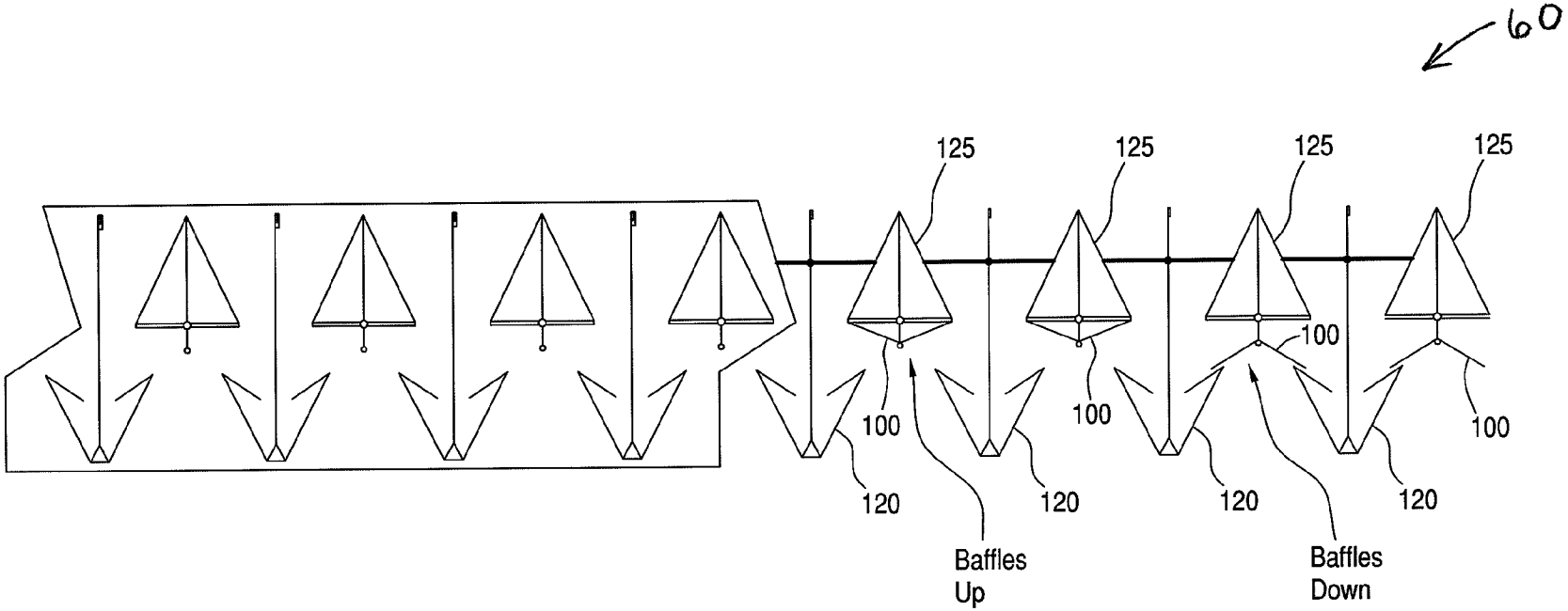
FIG. 7 is a side view of another embodiment of the present invention, comprising only a single layer of water collection troughs.

Another possible embodiment of the invention is shown in FIG. 7. This embodiment shares certain elements with the previously disclosed embodiment, but has only a single layer of troughs. In this embodiment, a single layer of troughs 120 as shown in FIG. 7 is disposed below fill 55. Water guide members 125 are positioned above troughs 120. Water guide members may have a generally inverted V cross section shape, a rectangular cross section shape, or other suitable shape. Baffles 100 are disposed between water guide members 125 and troughs 120. As in the previously described embodiments, baffles 100 rotate in response to air flow; in the position shown in the two rightmost trough sets of FIG. 7, where no air is moving vertically upward through the water collection system, baffles 100 rotate downward and cover the spaces between troughs 120. When air flow is present, as in the two leftmost trough sets of FIG. 7, baffles 100 rotate upward, and uncover the spaces between troughs 120. It is understood that the presence of vertically upward airflow prevents water from flowing through the spaces between the troughs.

Materials and Fabrication

Materials suitable for fabrication of the present invention include metals of different types, and non-metals such as plastics, fiberglass, etc. In particular, while the scope of the invention encompasses any suitable materials, many of the components can be made of reinforced fiberglass or similar materials, which provide a high strength at relatively low weight. The various components may be formed by different processes, including molding, extrusion, or other methods known in the art.

Fabrication of the cooling tower and components thereof are by means well known in the relevant art, including but not limited to the use of metal fasteners, adhesives, etc.

CONCLUSION

While the foregoing description sets forth a number of details associated with a presently preferred embodiment, it is understood that the scope of the invention is not limited to these examples. Various aspects for the cooling tower may be modified yet still fall within the scope of the invention, for example, dimensions may be modified to suit particular applications, different materials may by used in fabrication, multiple units maybe be used to provide needed cooling capacity, etc. While the described embodiments comprise one or two levels of troughs (upper and lower), it is understood that more than two levels of troughs, namely three or more, could be used within the scope of the invention.

Therefore, the scope of the invention is not limited by the illustrative embodiments shown herein, but by the scope of the appended claims and their legal equivalents.

We claim:

1. A cooling tower for the cooling of water, comprising:

an outer shell having a plurality of legs attached thereto, said outer shell having a length and a width;

a volume of fill material disposed within said outer shell, for passage of water vertically downward therethrough;

a means for distributing water across an upper surface of said fill material;

a means for moving air vertically upward through said fill material; and a water collection system disposed below said fill material, comprising:

a plurality of upper troughs substantially spanning said width of said outer shell, forming a first layer of troughs; and a plurality of lower troughs substantially spanning said width of said outer shell, forming a second layer of troughs disposed below said upper troughs and substantially parallel to said upper troughs;

one or more elongated dividers positioned above said lower troughs and substantially parallel to said lower troughs; and a plurality of pairs of elongated hinged baffles disposed substantially parallel to said upper and lower troughs and between said upper and lower troughs, and movable between a first position wherein said baffles cover the s aces between an upper trough and adjacent lower troughs below said upper trough, and a second position wherein said baffles are rotated upward to uncover said space.

2. The cooling tower of claim 1, further comprising one or more upper supports disposed above said upper troughs and substantially parallel to said upper troughs.

3. The cooling tower of claim 2, wherein said upper supports have a generally rectangular cross section shape.

4. The cooling tower of claim 2, wherein said upper supports have a generally inverted V cross section shape.

5. A water collection system for a cooling tower, wherein said cooling tower has a width and a length, comprising:

a plurality of elongated, spaced apart upper troughs substantially spanning said width, forming a first layer of troughs;

a plurality of elongated, spaced apart lower troughs substantially spanning said width and disposed below said upper troughs and substantially parallel to said upper troughs, forming a second layer of troughs, said lower troughs positioned so that a lower trough underlies the space between each two adjacent upper troughs;

one or more elongated vertical dividers, positioned above and aligned with said lower troughs; and a plurality of pairs of elongated baffles disposed between said upper and lower troughs and movable between a first position wherein said baffles cover the spaces between an upper trough and adjacent lower troughs, and a second position wherein said baffles are rotated upward to uncover said spaces.

6. The water collection system of claim 5, further comprising one or more elongated upper supports, positioned above and aligned with said upper troughs.

7. The water collection system of claim 6, wherein said upper supports have a generally rectangular cross section shape.

8. The water collection system of claim 6, wherein said upper supports have a generally inverted V cross section shape.

9. A cooling tower for the cooling of water, comprising:

an outer shell having a plurality of legs attached thereto, said outer shell having a length and a width;

a volume of fill material disposed within said outer shell, for passage of water vertically downward therethrough;

a means for distributing water across an upper surface of said fill material, said means comprising piping and a plurality of nozzles positioned above said fill material;

one or more fans positioned below said fill material, for moving air vertically upward through said fill material;

a water collection system disposed below said fill material, comprising:

a plurality of upper troughs substantially spanning said width of said outer shell, forming a first layer of troughs;

a plurality of lower troughs substantially spanning said width of said outer shell and forming a second layer of troughs disposed below said upper troughs and substantially parallel to said upper troughs;

one or more vertical dividers positioned above said lower troughs; and a plurality of pairs of baffles disposed between said upper and lower troughs, and rotably movable between a first position covering the spaces between an upper trough and adjacent lower troughs, and a second position uncovering said space, in response to upward vertical air movement.

10. The cooling tower of claim 9, further comprising a plurality of upper supports disposed above said upper troughs.

11. The cooling tower of claim 10, wherein said upper supports comprise generally inverted V cross section shapes.

12. The cooling tower of claim 9, wherein said vertical dividers comprise generally rectangular cross section shapes.

* * * * *